United States Patent [19]

Akerhielm et al.

[11] Patent Number: 4,475,354

[45] Date of Patent: Oct. 9, 1984

[54] SYSTEM FOR DRAINING LIQUID REFRIGERANT FROM A SUBCOOLER IN A VAPOR COMPRESSION REFRIGERATION SYSTEM

[75] Inventors: George J. Akerhielm, Manlius; Zoltan P. Mandy, Camillus, both of N.Y.

[73] Assignee: Carrier Corporation, Syracuse, N.Y.

[21] Appl. No.: 485,976

[22] Filed: Apr. 18, 1983

[51] Int. Cl.[3] ..... F25B 41/00

[52] U.S. Cl. ..... 62/117; 62/197

[58] Field of Search ..... 62/197, 174, 149, 181, 62/183, 184, 509, 506, 196.2, 196.1, 115, 117

[56] References Cited

U.S. PATENT DOCUMENTS

| | | | |
|---|---|---|---|
| 2,401,827 | 6/1946 | Heitchue | 62/196.2 X |
| 3,744,264 | 7/1973 | Ware | 62/149 X |
| 3,744,273 | 7/1973 | Ware | 62/149 X |

*Primary Examiner*—Harry Tanner

*Attorney, Agent, or Firm*—David L. Adour

[57] ABSTRACT

A vapor compression refrigeration system with a tube in shell subcooler for use in low temperature cooling applications such as in a brine chilling application is disclosed. The subcooler has a drain system for draining liquid refrigerant from the shell side of the subcooler at shutdown of the refrigeration system to prevent undesirable amounts of water from freezing in the tubes of the subcooler after shutdown of the refrigeration system.

7 Claims, 1 Drawing Figure

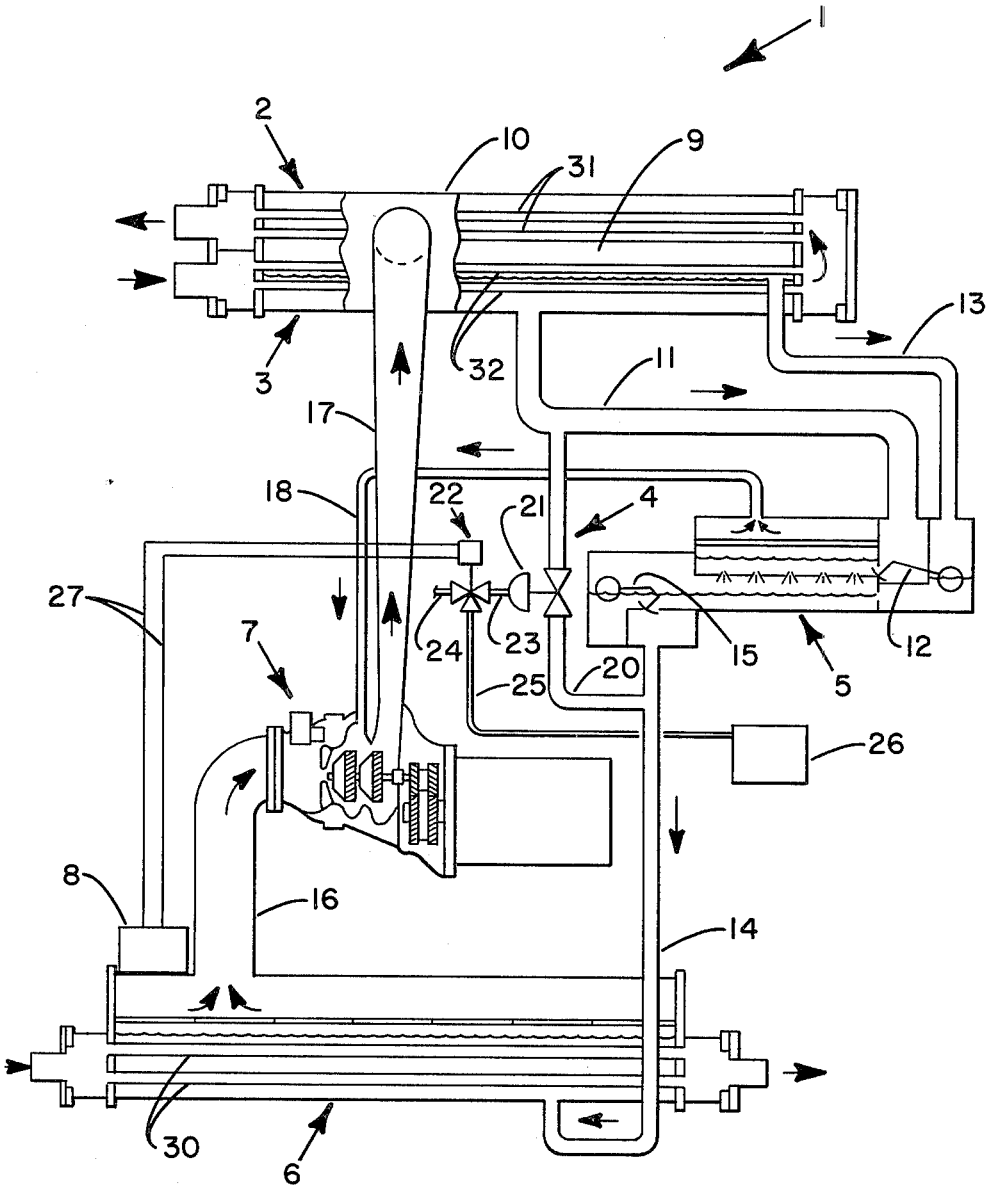
1
2
10
31
9
13
3
32
11
17
18
22
21
4
27
7
24
23
15
12
5
25
20
26
8
16
14
30
6

SYSTEM FOR DRAINING LIQUID REFRIGERANT FROM A SUBCOOLER IN A VAPOR COMPRESSION REFRIGERATION SYSTEM

BACKGROUND OF THE INVENTION

The present invention relates to vapor compression refrigeration systems having tube in shell heat exchangers and, more particularly, relates to vapor compression refrigeration systems having tube in shell subcoolers used in low temperature cooling applications such as in a brine chilling application.

It is well known that use of a subcooler with a standard cycle vapor compression refrigeration system reduces the refrigeration system compressor power requirements thereby improving the operating efficiency of the refrigeration system. However, in low temperature cooling applications such as a brine chilling application where brine is used as the heat exchange medium chilled in the evaporator of the vapor compression refrigeration system, tube in shell subcoolers have not been used because of the danger of freezing water, which is used in the tubes of the subcooler as a heat exchange medium, at shutdown of the refrigeration system. Water freeze-up is a problem because usually the brine in the evaporator is chilled in the evaporator to a temperature below the freezing temperature of water and equalization of refrigerant temperature and pressure in the refrigeration system at shutdown of the refrigeration system results in refrigerant temperatures in the subcooler dropping to a temperature below the freezing temperature of water for a period of time sufficient to freeze the water in the tubes of the subcooler. If too much water freezes in the tubes of the subcooler, then the subcooler tubes may break or other such undesirable results may occur.

The danger of freezing water in the tubes of the subcooler may be reduced by taking measures such as maintaining water flow through the tubes of the subcooler after shutdown of the refrigeration system for a period of time sufficient to allow the refrigeration system to equalize at a temperature above the freezing temperature of water. However, this type of operation is inefficient because a water pump must be maintained in operation for a period of time after each shutdown of the refrigeration system. Also, if the water pump should fail, or if there is a power failure for the refrigeration system, then subcooler freeze-up may still occur. Therefore, this is not a particularly satisfactory way of overcoming the subcooler freeze-up problem.

SUMMARY OF THE INVENTION

Therefore, it is an object of the present invention to simply and reliably operate vapor compression refrigeration systems with tube in shell subcoolers in low temperature cooling applications, such as a brine chilling application, without the danger of undesirable amounts of water freezing in the tubes of the subcooler at shutdown of the refrigeration system.

This and other objects of the present invention are attained by providing a vapor compression refrigeration system with a tube in shell subcooler having a drain system for quickly draining liquid refrigerant from the shell side of the subcooler at shutdown of the refrigeration system. The liquid refrigerant is drained fast enough to prevent refrigerant temperatures in the subcooler from dropping to temperatures below the freezing temperature of water for a period of time sufficient to freeze undesirable amounts of water in the tubes of the subcooler. A subcooler liquid refrigerant drain system, according to the present invention, may comprise a drain line connected between the subcooler and the evaporator of the refrigeration system, a valve located in the drain line, a sensor for sensing shutdown of the refrigeration system, and a control, responsive to the sensor, for opening the valve in the drain line to drain liquid refrigerant from the subcooler to the evaporator when the sensor senses shutdown of the refrigeration system.

BRIEF DESCRIPTION OF THE DRAWING

Other objects, features and advantages of the present invention will be apparent from the following detailed description in conjunction with the accompanying drawing in which:

The FIGURE is a schematic illustration of a vapor compression refrigeration system having a tube in shell subcooler with a drain system according to the present invention.

DESCRIPTION OF THE PREFERRED EMBODIMENT

The FIGURE shows a schematic illustration of a vapor compression refrigeration system 1 having a tube in shell subcooler 3 with a drain system 4 for draining liquid refrigerant from the subcooler 3 at shutdown of the refrigeration system 1 according to the principles of the present invention. The refrigeration system 1 is designed for use in low temperature cooling applications such as a brine chilling application. In addition to the tube in shell subcooler 3 with the drain system 4, the vapor compression refrigeration 1 includes a condenser 2, a flash economizer 5, an evaporator 6, a two-stage centrifugal compressor 7, and an electronic control center 8 for controlling the operation of the refrigeration system 1.

As shown in the FIGURE, the subcooler 3 and the condenser 2 are housed in one shell 10 having a partition plate 9 separating the subcooler section 3 from the condenser section 2. However, if desired, the condenser 2 and subcooler 3 may be housed in separate shells. Also, as shown in the FIGURE, a flash economizer 5 is included as part of the refrigeration system 1. However, if desired, the flash economizer 5 may be omitted from the refrigeration system 1 without altering the basic structure and operation of the present invention.

Also, as shown in the FIGURE, there is a subcooler liquid refrigerant outlet line 11 connecting the subcooler 3 and the flash economizer 5. Flow of liquid refrigerant through the subcooler liquid refrigerant outlet line 11 to the flash economizer 5 is controlled by a high pressure side float valve 12 which senses refrigerant liquid level in the subcooler 3 through a subcooler liquid level sensor line 13. A flash economizer liquid refrigerant outlet line 14 connects the flash economizer 5 to the evaporator 6. Flow of liquid refrigerant through the flash economizer liquid refrigerant outlet line 14 to the evaporator 6 is controlled by a low pressure side float valve 15. A compressor refrigerant vapor inlet line 16 connects the evaporator 6 to the inlet of the centrifugal compressor 7. A compressor refrigerant vapor outlet line 17 connects the outlet of the centrifugal compressor 7 to the condenser 2. An economizer flash gas outlet line 18 connects the flash economizer 5 to the second stage of the centrifugal compressor 7.

Further, as shown in the FIGURE, the drain system 4 comprises a drain line 20, a pressure operated control valve 21 located in the drain line 20, and a three-way solenoid valve 22 for opening and closing the pressure operated control valve 21. The drain line 20 is connected between the subcooler liquid refrigerant outlet line 11 and the flash economizer liquid refrigerant outlet line 14. The three-way solenoid valve 22 has an outlet pressure line 23 connected to the control valve 21, a first inlet pressure line 24 for connection to a relatively low pressure source, and a second inlet pressure line 25 for connection to a relatively high pressure source. As shown in the FIGURE, the relatively low pressure source is atmosphere surrounding the vapor compression refrigeration system 1 and the relatively high pressure source is a compressed air supply 26. Also, as shown in the FIGURE, electrical leads 27 electrically connect the three-way solenoid valve 22 to the electronic control center 8 for the vapor compression refrigeration system 1.

The drain line 20 is sized, positioned and configured relative to the refrigeration system 1 to drain substantially all of the liqud refrigerant from the subcooler 3 in a predetermined amount of time when the control valve 21 in the drain 20 is opened at shutdown of the refrigeration system 1. Of course, individual refrigeration systems will vary in their size and configuration. Therefore, to achieve a desired predetermined drain time for a particular refrigeration system, the drain line 20 must be especially sized, positioned and configured for the particular refrigeration system according to conventional hydraulic engineering principles depending on factors such as the difference in height between the subcooler 3 and evaporator 6, the refrigerant pressure difference between the subcooler 3 and evaporator 6 at shutdown of the refrigeration system 1, the size of the subcooler 3, and the amount of liquid refrigerant normally present in the subcooler 3 at shutdown of the refrigeration system 1.

According to the present invention, the predetermined drain time for the drain system 4 is selected to be less than the amount of time in which an undesirable amount of water may freeze in the tubes 32 of the subcooler 3 after shutdown of the refrigeration system 1. This freezing time may be determined in a variety of ways which will be readily apparent to one of ordinary skill in the art to which the present invention pertains. For example, one way of determining this freezing time is to calculate the amount of time after shutdown of the refrigeration system 1 necessary to freeze enough water in one of the tubes 32 of the subcooler 3 to exceed a designed stress limitation for the tube. This calculation may be carried out by considering the ice which builds up in the tube and the tube itself as two tubes with an interference fit caused by the differential thermal expansion between the ice and the tube. This thermal expansion of the ice is restrained by the tube causing hoop stress in the tube wall. The time required to freeze ice in the tube to the designed stress limit may be calculated at different equalization refrigerant temperatures for the subcooler 3 by considering the thermal resistance of the ice, the thermal resistance of the material from which the tube is made, and the thermal resistance of the film of refrigerant on the outside surface of the tube. The heat flux equation for an infinite long tube combined with the latent heat of solidification for water gives the freezing time. A worst case freezing time is calculated by assuming a worst case equalization temperature, by assuming that there is stagnant water in the subcooler tubes 32 at shutdown of the refrigeration system 1, by neglecting the thermal expansion of the material from which the tubes are made, and by neglecting the sensible cooling of water in the subcooler tubes 32. Based on this calculated worst case freezing time and based on engineering experience and judgement regarding a particular refrigeration system 1, one may select a safe freezing time for the refrigeration system 1 and design the drain system 4 to have a drain time less than this selected safe freezing time.

As shown in the FIGURE, the pressure operated control valve 21 in the drain line 20 is an air pressure operated valve such as a butterfly type valve. The control valve 21 is open when atmospheric air pressure is supplied to the control valve 21 through the outlet pressure line 23 of the solenoid valve 22 and is closed when higher pressure air from the compressed air supply 26 is supplied to the control valve 21 through the outlet pressure line 23 of the solenoid valve 22. The three-way solenoid valve 22 may be any one of a variety of such valves for connecting an outlet line to either one of two inlet lines while effectively sealing off the other inlet line from the outlet line. Preferably, the three-way solenoid valve 22 is electrically connected by the electrical leads 27 to the electronic control center 8 so that the outlet pressure line 23 is connected to the first inlet pressure line 24 when no electrical power is supplied to the solenoid valve 22 from the electronic control center 8 and so that the outlet pressure line 23 is connected to the second inlet pressure line 25 when electrical power is supplied to the solenoid valve 22 from the electronic control center 8. Thus, the control valve 21 in the drain line 20 is closed when electrical power is supplied to the solenoid valve 22 because then the relatively high pressure air source is connected to the control valve 21 and the control valve 21 is open when no electrical power is supplied to the solenoid valve 22 because then the relatively low pressure air source is connected to the control valve 21.

In addition to controlling the overall operation of the refrigeration system 1, the electronic control center 8 includes electrical components for monitoring the operation of the refrigeration system 1. For example, the electronic control center 8 may include electrical components for sensing electrical power flow to the motor for the centrifugal compressor 7. When electrical power flow is sensed, the refrigeration system 1 is operating and the electronic control center 8 supplies electrical power through the electrical leads 27 to the solenoid valve 22 thereby causing the control valve 21 in the drain line 20 to close. When no electrical power flow is sensed, the refrigeration system is not operating and the electronic control center 8 supplies no electrical power through the electrical leads 27 to the solenoid valve 22 thereby causing the control valve 21 in the drain line 20 to open and drain liquid refrigerant from the subcooler 3.

Of course, it should be noted that the above described drain system 4 is only one example of a drain system for a subcooler according to the principles of the present invention and many other such drain systems and modifications to the above described drain system 4 will be readily apparent to one of ordinary skill in the art to which the present invention pertains. For example, if desired, the drain line 20 inlet may be connected directly to the subcooler 3 and/or the drain line 20 outlet may be connected directly to the evaporator 6. Alternatively, no special drain line 20 need be provided and, instead, at shutdown of the refrigeration system 1 the high pressure side float valve 12 may be opened to drain the liquid refrigerant from the subcooler 3 through the subcooler liquid refrigeration outlet line 11 into the flesh economizer 5. However, this requires use of an oversized opening with an oversized high pressure side float valve 12 at the entrance to the flash economizer 5 and a suitable control system for fully opening the high pressure side float valve 12 only at shutdown of the refrigeration system 1. These requirements may be difficult to accomplish with many typical refrigeration systems because of inherent mechanical and operational problems with oversized float valves thus making this arrangement less desirable than the drain system embodiment with the drain line 20 described above.

Also, if desired, a total electronic valving and control system may be used in place of the pressure operated control valve 21 and the three-way solenoid valve 22 shown in the FIGURE. Alteratively, a control system may be used which monitors the refrigerant pressure differential between the condenser 2 and the evaporator 6. The control valve 21 in the drain line 20 is opened when the monitored pressure differential falls below a preselected level indicating that the refrigeration system 1 is not operating. Of course, the foregoing examples are only some of the many modifications and alternatives which may be made within the scope of the present invention.

During normal operation of the vapor compression refrigeration system 1 shown in the FIGURE, liquid refrigerant is evaporated in the evaporator 6 to chill a low temperature cooling medium such as brine flowing through tubes 30 in the evaporator 6. The chilled medium from the evaporator 6 is provided to heat exchanger means (not shown) for providing cooling capacity in an industrial process or for another such purpose. Normally, when a medium such as brine is used as the heat exchange medium in the tubes 30 of the evaporator 6, this heat exchange medium is chilled to a temperature below the freezing temperature of water. For example, brine may be chilled to a temperature of 0° to 5° Fahrenheit.

The refrigerant vapor from the evaporator 6 flows through the compressor refrigerant vapor inlet line 16 into the two-stage centrifugal compressor 7 which compresses the refrigerant vapor and supplies this compressed refrigerant vapor through the compressor refrigerant vapor outlet line 17 to the condenser 2. Relatively cool water flows through tubes 31 in the condenser 2 to cool the refrigerant vapor and condense the vapor to a liquid. The condensed liquid refrigerant from the condenser 2 is supplied to the subcooler 3 wherein the liquid refrigerant is further cooled by relatively cooler water flowing through tubes 32 in the subcooler 3. As shown in the FIGURE, water flowing through the tubes 32 in the subcooler 3 is maintained at a lower temperature than water flowing through the tubes 31 in the condenser 2 by routing cooling water first through the tubes 32 in the subcooler 3 and then through the tubes 31 in the condenser 2. However, if desired, a separate water flow circuit may be provided for the condenser 2 and for the subcooler 3 or other kinds of water flow circuiting may be used.

It should be noted that the subcooler 3 is the type of subcooler (also known as a thermal economizer) which lowers the temperature of the liquid refrigerant flowing through the shell side of the subcooler 3 by sensible heat transfer to water flowing through the tubes 32 in the subcooler 3. Thus, during normal operation of the refrigeration system 1, it is desirable to maintain the subcooler 3 full of liquid refrigerant. This desired level of liquid refrigerant in the subcooler 3 is maintained by operation of the high pressure side float valve 12 which controls the amount of flow of liquid refrigerant from the subcooler 3 through the subcooler liquid refrigerant outlet line 11 to the flash economizer 5.

Also, during normal operation of the refrigeration system 1, the pressure operated control valve 21 in the drain line 20 is closed to prevent refrigerant from flowing through the drain line 20. The control valve 21 is closed because the electronic control center 8 senses operation of the refrigeration system 1 and in response thereto supplies electrical power to the three-way solenoid valve 22 which connects the outlet pressure line 23 to the inlet pressure line 25. Thus, the relatively high pressure air source is connected to the control valve 21 causing the control valve 21 to close during normal operation of the refrigeration system 1.

The subcooled refrigerant liquid from the subcooler 3 flows through the subcooler liquid refrigerant oulet line 11 to the flash economizer 5. A portion of this subcooled liquid refrigerant is flashed in the flash economizer 5 to further cool the remaining liquid portion of the refrigerant in the flash economizer 5. The flashed refrigerant from the flash economizer 5 is supplied through the economizer flash gas outlet line 18 to the second stage of the compressor 7 wherein the refrigerant gas is recompressed and supplied back to the condenser 2. The relatively cold liquid portion of the refrigerant is supplied from the flash economizer 5 to the evaporator 6 through the flash economizer liquid refrigerant outlet line 14. The flow of this relatively cold liquid refrigerant through the flash economizer liquid refrigerant outlet line 14 to the evaporator 6 is controlled by operation of the low pressure side float valve 15.

At shutdown of the vapor compression refrigeration system 1, the centrifugal compressor 7 will cease operation and equalization of refrigerant pressure and temperature will occur in the refrigeration system 1. During this equalization period, a portion of the liquid refrigerant in the subcooler 3 will evaporate thereby greatly cooling the remaining portion of the liquid refrigerant in the subcooler 3. This will occur at shutdown because of exposure of the relatively high pressure and temperature refrigerant in the condenser 2 and the subcooler 3 to the relatively low pressure and temperature refrigerant on the low pressure side of the refrigeration system 1. If the evaporator 6 of the vapor compression refrigeration system 1 has been operating before shutdown at a relatively low refrigerant pressure and temperature, which is normally the case when the refrigeration system 1 is used in low temperature cooling applications such as in a brine chilling application, at shutdown, the liquid refrigerant temperature in the subcooler 3 may equalize to a temperature below the freezing temperature of water. As discussed previously, if the liquid refrigerant temperature in the subcooler 3 remains too long at this equalization refrigerant temperature below the freezing temperature of water then there is a danger of freezing an undesirable amount of water in the tubes 32 of the subcooler 3.

However, according to the principles of the present invention, this danger of freezing undesirable amounts of water in the tubes 32 of the subcooler 3 at shutdown of the refrigeration system 1 is prevented by operation of the drain system 4. As described previously, the electronic control center 8 monitors the operation of the refrigeration system 1 and when the electronic control center 8 senses shutdown of the vapor compression refrigeration system 1 electrical power flow is discontinued to the three-way solenoid valve 22 of the drain system 4. This causes the three-way solenoid valve 22 to switch the air pressure connection of the outlet pressure line 23 from the inlet pressure line 25 which is connected to the relatively high pressure air source to the input pressure line 24 which is connected to the relatively low pressure air source. This causes the control valve 21 to open the drain line 20 thereby substantially draining all of the liquid refrigerant from the subcooler 3 in a predetermined amount of time which is less than the freezing time for the subcooler 3 thereby preventing any subcooler 3 freeze-up problems. Also, it should be noted that, with this type of control system for the control valve 21, if there is a total electrical power failure for the refrigeration system 1, then no electrical power will flow to the solenoid valve 22 and the subcooler 3 will be drained by the drain system 4 to prevent freeze-up problems in this situation.

Of course, the foregoing description is directed to one particular preferred embodiment of the present invention and various modifications and other embodiments of the present invention will be readily apparent to one of ordinary skill in the art to which the present invention pertains. Therefore, while the present invention has been described in conjunction with a particular embodiment, it is to be understood that various modifications and other embodiments of the present invention may be made without departing from the scope of the present invention as described herein and as claimed in the appended claims.

We claim:

1. A drain system for draining refrigerant from the shell side of a tube in shell subcooler in a vapor compressor refrigeration system to prevent freezing of undesirable amounts of a heat exchange medium in the tubes of the subcooler at shutdown of the refrigeration system, said drain system comprising:

a drain means for removing refrigerant from the subcooler;

a valve means for opening and closing the drain means;

a sensor means for sensing operation of the vapor compression refrigeration system; and a control means for controlling the operation of the valve means to close the drain means when the sensor means senses operation of the vapor compression refrigeration system and to open the drain means when the sensor means does not sense operation of the vapor compression refrigeration system.

2. A drain system for draining refrigerant from the shell side of a tube in shell subcooler in a vapor compression refrigeration system as recited in claim 1 wherein the drain means comprises:

a drain line which is sized, positioned and configured relative to the other components of the refrigeration system, to drain substantially all of the liquid refrigerant from the subcooler in a predetermined amount of time which is less than a preselected freezing time for the subcooler, when the drain line is opened at shutdown of the refrigeration system.

3. A drain system for draining refrigerant from the shell side of a tube in shell subcooler in a vapor compression refrigeration system as recited in claim 2 wherein the valve means comprises:

a pressure operated control valve, located in the drain line, for opening the drain line when a relatively low pressure is supplied to said control valve and for closing the drain line when a relatively high pressure is supplied to said control valve.

4. A drain system for draining refrigerant from the shell side of a tube in shell subcooler in a vapor compression refrigeration system as recited in claim 3 wherein the control means comprises:

a three-way solenoid valve having a first input pressure line connected to a relatively low pressure source, a second input pressure line connected to a relatively high pressure source, and an output pressure line connected to the pressure operated control valve, for connecting the pressure operated control valve to the relatively low pressure source when no electrical power is supplied to operate said solenoid valve and for connecting the pressure operated control valve to the relatively high pressure source when electrical power is supplied to operate said solenoid valve.

5. A drain system for draining refrigerant from the shell side of a tube in shell subcooler in a vapor compression refrigeration system as recited in claim 4 wherein the sensor means comprises:

an electronic control center for sensing operation of the compressor motor of the refrigeration system and for supplying electrical power to operate the three-way solenoid valve when operation of the compressor motor is sensed and for discontinuing the flow of electrical power to the three-way solenoid valve when operation of the compressor motor is not sensed.

6. A method of operating a vapor compression refrigeration system having a tube in shell subcooler to prevent freezing of undesirable amounts of a heat exchange medium in the tubes of the subcooler at shutdown of the vapor compression refrigeration system, said method comprising the steps of:

controlling the flow of refrigerant from the subcooler to maintain a desired level of liquid refrigerant in the subcooler when the refrigeration system is operating;

sensing shutdown of the refrigeration system; and removing substantially all of the liquid refrigerant from the subcooler in a preselected amount of time, which is less than a predetermined freezing time for the subcooler, when shutdown of the refrigeration system is sensed.

7. A method of operating a vapor compression refrigeration system having a tube in shell subcooler as recited in claim 6 wherein the step of removing substantially all of the liquid refrigerant from the subcooler comprises:

draining the liquid refrigerant through a drain line from the subcooler to the evaporator of the refrigerant system when shutdown of the refrigeration system is sensed.

* * * * *